US009869146B2

(12) United States Patent
Mageren et al.

(10) Patent No.: US 9,869,146 B2
(45) Date of Patent: Jan. 16, 2018

(54) METHODS AND APPARATUS FOR CORING

(71) Applicant: Halliburton Energy Services, Inc., Houston, TX (US)

(72) Inventors: Olivier Mageren, Jette (BE); Aurelien Chauviere, Uccle (BE); Khac Nguyen Che, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 397 days.

(21) Appl. No.: 13/864,830

(22) Filed: Apr. 17, 2013

(65) Prior Publication Data

US 2014/0311805 A1 Oct. 23, 2014

(51) Int. Cl.
*E21B 25/06* (2006.01)
*E21B 25/00* (2006.01)
*E21B 25/10* (2006.01)

(52) U.S. Cl.
CPC ..... *E21B 25/06* (2013.01); *E21B 25/00* (2013.01); *E21B 25/10* (2013.01)

(58) Field of Classification Search
CPC ..... E21B 25/10
See application file for complete search history.

(56) References Cited

U.S. PATENT DOCUMENTS 1,671,544 A * 5/1928 Raymond ..... E21B 25/00 175/394
1,907,154 A * 5/1933 Mitchell ..... E21B 10/26 175/391
2,555,580 A * 6/1951 Deely ..... E21B 25/00 175/228
3,301,336 A * 1/1967 Mount ..... E21B 7/1245 175/135
4,312,414 A * 1/1982 Park ..... E21B 25/06 175/249
4,512,423 A * 4/1985 Aumann ..... E21B 25/06 175/226
4,598,777 A * 7/1986 Park ..... E21B 25/08 175/226
4,606,417 A 8/1986 Webb et al.
5,901,798 A 5/1999 Herrera et al.
6,158,534 A 12/2000 Fanuel
2004/0256151 A1 12/2004 Wada et al.
(Continued)

FOREIGN PATENT DOCUMENTS

CN 105189914 A 12/2015
DE 112014002033 T5 1/2016
(Continued)

OTHER PUBLICATIONS

"International Application Serial No. PCT/US2014/034171, International Search Report dated Aug. 19, 2014", 4 pgs.
(Continued)

*Primary Examiner* — Robert E Fuller
*Assistant Examiner* — Steven MacDonald
(74) *Attorney, Agent, or Firm* — Gilliam IP PLLC

(57) ABSTRACT

Described herein is an inner tube for a core barrel which has a structure adapted to retain lubricant for lubricating a sampled core. The internal surface of the inner tube includes a plurality of structures to retain lubricant adjacent a core received in the inner tube. An example structure is multiple alveoli in which lubricant is retained.

22 Claims, 6 Drawing Sheets

(56) References Cited

U.S. PATENT DOCUMENTS

| | | | | |
|---|---|---|---|---|
| 2010/0130060 | A1* | 5/2010 | Islam | H01R 9/0521 439/584 |
| 2010/0223989 | A1 | 9/2010 | Reid et al. | |
| 2015/0247369 | A1* | 9/2015 | Beach | E21B 25/16 175/251 |

FOREIGN PATENT DOCUMENTS

| | | |
|---|---|---|
| GB | 2527429 | 10/1950 |
| WO | WO-2014/172354 A1 | 10/2014 |

OTHER PUBLICATIONS

"International Application Serial No. PCT/US2014/034171, Written Opinion dated Aug. 19, 2014", 10 pgs.
"International Application Serial No. PCT/US2014/034171, International Preliminary Report on Patentability dated Oct. 29, 2015", 12 pgs.
"Canadian Application Serial No. 2,902,894, Office Action dated Jul. 28, 2016", 4 pgs.
"Canadian Application Serial No. 2,902,894, Second Office Action dated Apr. 28, 2017.", 4 pages.
"Chinese Application Serial No. 201480010783X; First Office Action dated Feb. 4, 2017", 6 pages (including English summary).

* cited by examiner

METHODS AND APPARATUS FOR CORING

FIELD OF THE INVENTION

The present invention relates generally to improvements in or relating to coring, and is more particularly concerned with improving lubrication between a core and the portion of a core barrel in which it is received.

BACKGROUND

In the field of oil exploration, it is known to use core barrel assembly to receive a sampled core. In some cases, the core barrel assembly will include an internal inner tube to facilitate extracting a core from a formation for testing. It is important to maintain the extracted core in substantially the same condition as it was in the formation. Various techniques have been used to preserve the integrity of the core. In one technique, the core is coated with a gel that is extruded onto the external surface of the core during the coring operation. However, while the gel protects the core, it is often difficult to remove it from the core for testing. In addition to maintaining the integrity of the core, it is important that the core does not jam in the core barrel assembly.

SUMMARY

Accordingly, the present disclosure identifies new methods and apparatus for providing an improved interface between a core barrel assembly and a received core. In one example system, the core barrel assembly will include an inner tube with a surface configured to facilitate lubrication of a received core. In selected examples, such an inner tube will include an external surface and an internal surface, and the internal surface will be configured to include at least one structure configured to retain a lubricant for lubricating a sampled core. Such structures may be of one or more of a variety of configurations, examples of which are described herein.

DESCRIPTION OF PREFERRED EMBODIMENTS

Figure 1:
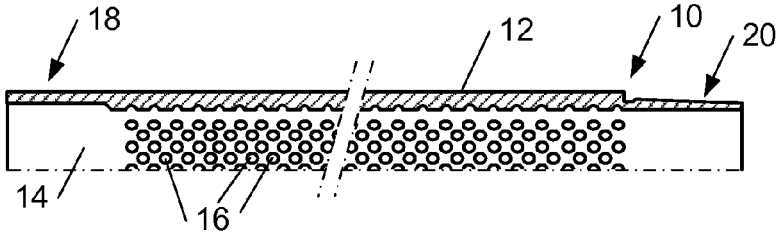
FIG. 1 illustrates a partial sectioned view of an inner tube having a dimpled internal surface in accordance with a first example embodiment.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes. The terms "vertical" and "horizontal" are used herein to refer to particular orientations of the Figures and these terms are not limitations to the specific embodiments described herein.

The present invention relates to improving lubrication between a sampled core and an inner tube of a core barrel to reduce the risk of jamming of the sampled core within the inner tube. The improved lubrication may be provided by any one of a number of structures as will be described in more detail below, which may be implemented either directly in the inner tube, or alternatively in a liner disposed therein. Alternatively, in some embodiments, the described structures might be formed directly within the inner surface of the core barrel. Accordingly, in the discussion of FIGS. 1-24 below the described structures are described in reference to being formed in an inner tube that will fit within the core barrel, in one preferred configuration, but such description should be understood to also be representative of formation of the structures in either an inner tube liner, or in a core barrel. For ease of explanation, in each embodiment described below, a sampled core enters the inner tube, where appropriate, in a direction from the right to the left of the relevant Figure.

Referring initially to FIG. 1, a partial longitudinal sectioned view of an inner tube 10 is shown which is located within a core barrel (as depicted at 220 in FIG. 25) for coring operations. The inner tube 10 comprises an external surface 12 and an internal surface 14 on which a plurality of shallow alveoli or dimples 16 are formed. A box (female) connector 18 is formed at one end of the inner tube 10 and a pin (male) connector 20 is formed at the other end the inner tube 10, the inner tube 10 being connected to other elements in the core barrel by means of the box and pin connectors 18, 20. It will be appreciated that in other embodiments, the inner tube 10 may comprise identical connectors on each end. The inner tube 10 is preferably made from a rigid material, for example, steel, aluminium, an alloy, a glass-reinforced plastic material (GRP), a carbon-reinforced material (CRP), or any other suitable material.

The alveoli or dimples 12 can be considered to be similar to the dimples formed on the external surface of a golf ball and are closely-packed. Each alveolus or dimple 16 acts as a micro-lubricant reservoir which traps mud circulating through the drill string, this mud constantly lubricating the sampled core (not shown) with a layer of mud as the core passes over each alveolus or dimple as it enters the inner tube 10. By providing the alveoli or dimples 16, the sampled core cannot act as a mud wiper, pushing mud away from the internal surface 14, as it enters the inner tube 10 as would be the case if the internal surface 14 were to be smooth and not have the alveoli or dimples 16. Such alveoli or dimples 16 are not limited for use with mud as a lubricant and other suitable lubricants can be used that do not affect the integrity of the sampled core. For example, oils, greases and pastes having high uniformity and high viscosity can be used as these materials can readily be retained within the alveoli or dimples 16. In some cases, the lubricants can be provided to the retention structures, while in other examples, such as that of FIG. 1, above, the lubricant may be present, as in the example of drilling mud, and may be trapped by the structures and thereby retained proximate a received core. In other cases, as addressed in more detail later herein, a solid low-friction material may be deposited in the structures, and thereby retained proximate a received core surface.

Figure 2:
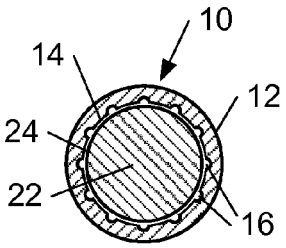
FIG. 2 illustrates a cross-section through the inner tube of FIG. 1 with a core in place.

FIG. 2 illustrates a cross-sectioned view through the inner tube 10 of FIG. 1 with a sampled core 22 located within the inner tube 10. As shown, lubricant (not shown) within the alveoli or dimples 16 provide a lubricating layer 24 between the internal wall 14 and the sampled core 22.

Although in the embodiment of the inner tube 10 described with reference to FIGS. 1 and 2, the alveoli or dimples 16 are formed on the internal surface 14, it will readily be understood that a liner, as will be described in more detail below with reference to FIG. 8, could be provided for the inner tube 10 on which the alveoli or dimples 16 are formed, and which would provide the same lubricating effect.

In the embodiments described below, the connectors 18, 20 (FIG. 1) are not shown as only a portion of the inner tube is shown in each case. It will be appreciated that the inner tube may carry box and pin connectors at each of its ends, or such other connection mechanisms as required for engagement with a core barrel.

Figure 3:
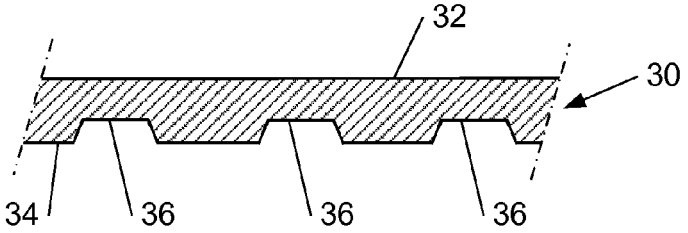
FIG. 3 illustrates a partial longitudinal sectioned view of an inner tube having radial grooves formed in its internal surface in accordance with a second example embodiment.

In FIG. 3, a partial longitudinal sectioned view of a wall of an inner tube 30 is shown in accordance with a second example embodiment. The inner tube 30 comprises an external surface 32 and an internal surface 34 on which a plurality of radial grooves 36 is formed. The radial grooves 36 are sized to retain lubricant in a similar way to the alveoli or dimples 12 in FIG. 1. However, it will be appreciated that different quantities of lubricant can be trapped by the grooves 36 than by the alveoli or dimples 16 (FIG. 1).

The spacing between the grooves 36 is arranged such that a substantially uniform lubricant layer is formed over the internal surface 34 so that the sampled core (not shown) is separated from the internal surface 34 in a similar way to that described above with reference to FIG. 2. In one embodiment, the radial grooves 36 are equally spaced from one another along the length of the inner tube 30. In another embodiment, the radial grooves 36 may be distributed at different intervals along the length of the inner tube 30. For example, the radial grooves 36 may be more closely spaced together at the entrance to the inner tube 30 so as to be able to provide more lubricant to a sampled core as it enters the inner tube 30 with a wider spacing further into the inner tube.

It will readily be appreciated that the radial grooves 36 may also be formed in an internal surface of a liner (not shown) which is inserted into the inner tube 30, the internal surface of the liner being configured to have the radial grooves that retain lubricant in the same way as the internal surface 34 of the inner tube 30 as described above.

Figure 4:
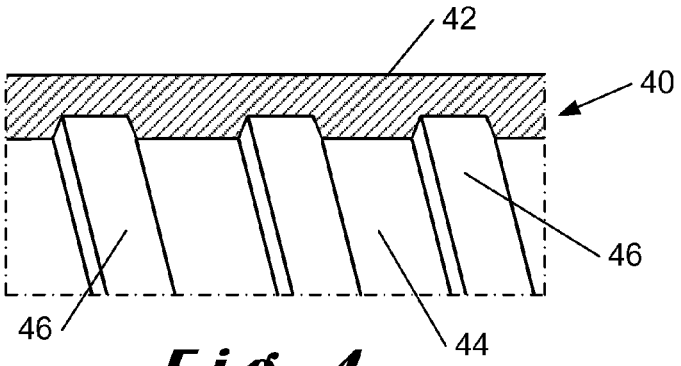
FIG. 4 illustrates a partial sectioned view of an inner tube having a helical groove formed in its internal surface in accordance with a third example embodiment.

In FIG. 4, a partial longitudinal sectioned view of a wall of an inner tube 40 is shown. The inner tube 40 has an external surface 42 and an internal surface 44 in which a helical groove 46 is formed. The helical groove 46 retains lubricant, for example, mud, for a sampled core (not shown). In one implementation of this structure, the helical groove 46 has a constant depth, width and pitch along the length of the inner tube 40. In another implementation, the depth, width and/or pitch of the helical groove 46 may vary along the length of the inner tube, for example, with deeper grooves with smaller pitch and/or narrower width at the entrance to the inner tube and shallower grooves with larger pitch and/or greater width further into the inner tube. The variation in depth, width and pitch of the helical groove 46 provides a way of controlling the amount of lubrication available for lubricating the sampled core.

Although only one helical groove is shown, it will be appreciated that more than one helical groove may be provided. Where multiple helical grooves are provided, each helical groove may have a different depth, width and/or pitch to any other helical groove. The helical groove 46 is shown as a single helix but it will be appreciated that an arrangement comprising two helical grooves running in opposite directions in the internal surface 44 is also possible, as shown in FIG. 5.

Figure 5:
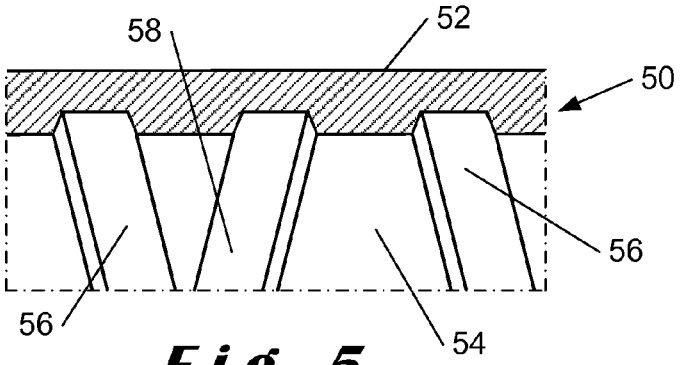
FIG. 5 is similar to FIG. 4 but has two helical grooves formed in its internal surface, the two helical grooves running in opposite directions in accordance with a fourth example embodiment.

In FIG. 5, a partial longitudinal sectioned view of a portion of an inner tube 50 having an external surface 52 and an internal surface 54 is shown in which two helical grooves 56, 58 are formed on the internal surface 54 of the inner tube 50. Helical groove 56 rotates in one direction similar to groove 46 shown in FIG. 4, and helical groove 58 rotates in the opposite direction along the length of the inner tube 50. By varying the depth, width and pitch of the helical grooves 56, 58 (as described above with reference to FIG. 4), a way of controlling the amount of lubrication available for lubricating the sampled core is provided.

It will be appreciated that more than one helical groove may be provided in each direction, and each helical groove may have a different depth, width and/or pitch to any other helical groove in the same or opposite direction.

Figure 6:
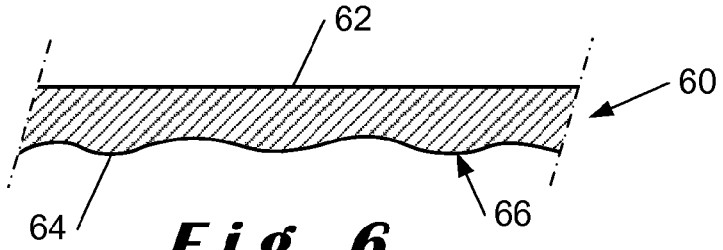
FIG. 6 illustrates a partial sectioned view of an inner tube having an undulating internal surface in accordance with a fifth example embodiment.

FIG. 6 illustrates a partial longitudinal sectioned view of a wall of an inner tube 60. The inner tube 60 has an external surface 62 and an internal surface 64, the internal surface 64 having a variable geometry, for example, an undulating or wavy surface. The term "variable geometry" as used herein refers to a surface that varies in cross-section along and/or across its length. As before, the variable geometry is chosen to retain a lubricant for the sampled core (not shown).

Figure 7:
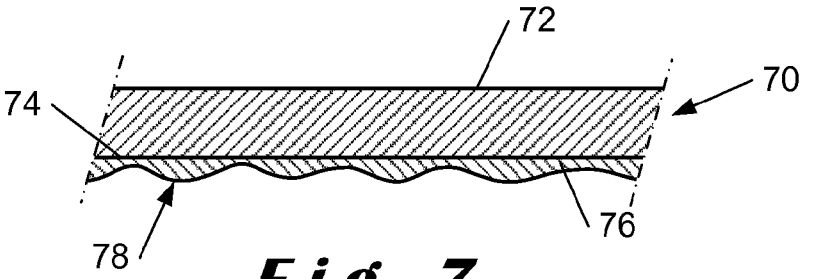
FIG. 7 illustrates a partial sectioned view of an inner tube having an internal surface of variable geometry in accordance with a sixth example embodiment.

FIG. 7 illustrates a partial longitudinal sectioned view of a wall of an inner tube 70 which has an external surface 72 and an internal surface 74. A structured layer 76 is formed on the internal surface 74 which provides a surface 78 having a variable geometry in which lubricant can be trapped. The structured layer 76 may comprise an adhesive material which, when set, forms the surface 78. For example, the adhesive material may comprise an epoxy resin which is applied to the internal surface 74 and allowed to set to form the surface 78.

Alternatively, the structured layer 76 may comprise a thermosetting polymer, for example, a synthetic rubber, or other suitable material which can be applied to the internal surface 74 of the inner tube 70 and allowed to set to form the surface 78. In another alternative, the structured layer 76 may be provided by a liner configured to provide the surface 78.

Figure 8:
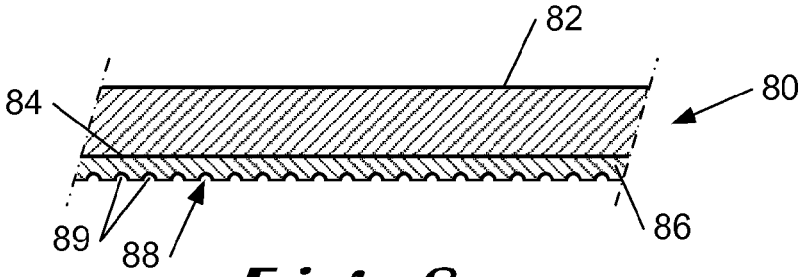
FIG. 8 illustrates a partial sectioned view of an inner tube having a liner with alveoli or dimples formed in its internal surface in accordance with a seventh example embodiment.

In FIG. 8, a partial longitudinal sectioned view of a wall of an inner tube 80 is shown. The inner tube has an external surface 82 and an internal surface 84. A liner 86 is provided which is arranged to cover the internal surface 84, the liner 86 having an internal surface 88 which is textured to retain lubricant. In the illustrated embodiment, the internal surface 88 is similar to the internal surface 14 of FIGS. 1 and 2 in that alveoli or dimples 89 are provided thereon.

Figure 9:
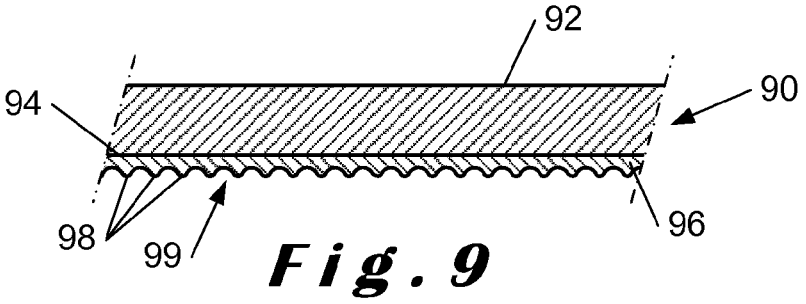
FIG. 9 illustrates a partial section view of an inner tube having a liner with protrusions in accordance with an eighth example embodiment.

FIG. 9 illustrates a partial longitudinal sectioned view of a wall of an inner tube 90. The inner tube 90 has an external surface 92 and an internal surface 94. A Teflon® layer 96 is formed on the internal surface 94 of an inner tube 90. [Teflon is a registered trademark of the DuPont Corporation.] The layer 96 has a plurality of projections 98 formed on its surface 99. Between the projections 98, lubricant can be trapped in a similar way to the embodiments described above.

Figure 10:
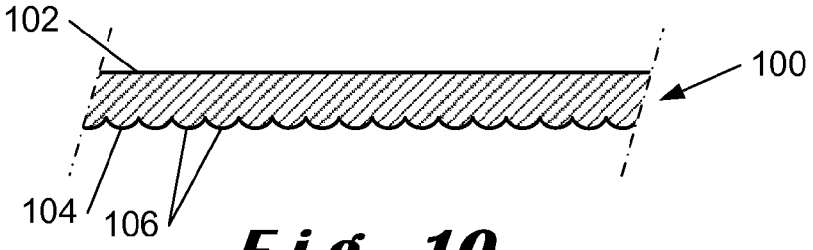
FIG. 10 illustrates a partial sectioned view of an inner tube having a structured internal surface in accordance with a ninth example embodiment.

FIG. 10 shows a partial longitudinal sectioned view of a wall of an inner tube 100. The inner tube has an external surface 102 and an internal surface 104. The surface 104 comprises a helicoidal shape similar to the outside of a vacuum cleaner hose and provides depressions 106 in which lubricant can be trapped.

As an alternative to forming the helicoidal shape in the internal surface 104 of the inner tube 100, the helicoidal shape may be formed in a liner which is arranged inside the inner tube against the internal surface thereof.

Figure 11:
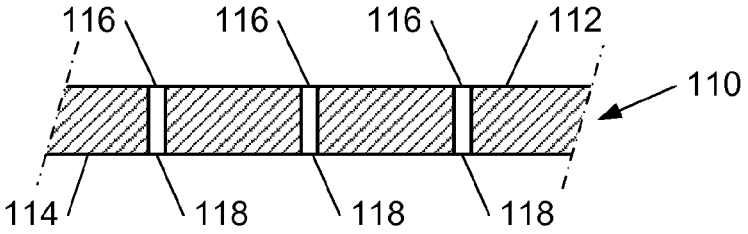
FIG. 11 illustrates a partial sectioned view of an inner tube having holes formed therein in accordance with a tenth example embodiment.
Figure 12:
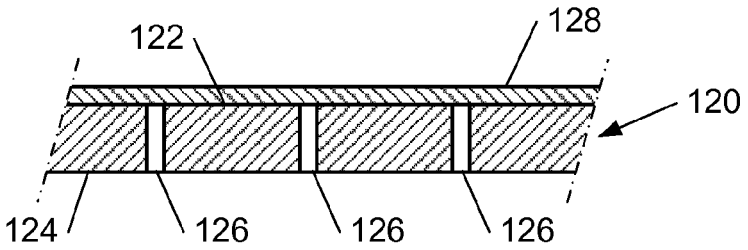
FIG. 12 is similar to FIG. 11 but includes an external skin in accordance with an eleventh example embodiment.
Figure 13:
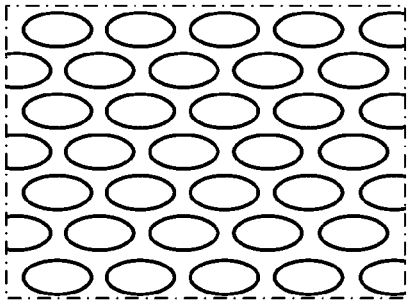
FIG. 13 illustrates an internal surface of an inner tube or a liner having a plurality of holes formed therein.

It will be appreciated that the inner tube structures described above with reference to FIGS. 1 to 10 provide a surface shape or texture in which lubricant can be trapped. In FIGS. 11 to 13, holes are used to retain the lubricant as described in more detail below.

FIG. 11 illustrates a partial longitudinal sectioned view of a wall of an inner tube 110 in accordance with the present invention. Here, the inner tube 110 has an external surface 112 and an internal surface 114 with a plurality of holes 116 extending from the external surface 112 to the internal surface 114 as shown. The inner tube 110, in use, is located within an outer tube (not shown) of a core barrel with its external surface 112 adjacent the internal surface of the outer tube. An annular space (also not shown) may be provided between the internal surface of the outer tube and the external surface 112 of the inner tube 110 through which lubricant can be directed. In this case, the lubricant may comprise drilling fluid, that is, mud, which flows through the holes 116 and are trapped at exit points 118 of the holes 116 on the internal surface 114 of the inner tube 110 to provide a lubricating layer inside the inner tube 110.

The holes 116 may be distributed evenly over the length of the inner tube 110 or may be more concentrated in particular areas, for example, at the entrance to the inner tube to provide more lubrication as the sample core enters the inner tube.

Such an inner tube 110 can be used in a core barrel utilising a triple tube arrangement where the inner tube and an intermediate tube, that is, the tube surrounding the inner tube, together form a combined inner tube located within the outer tube.

In FIG. 12, a partial longitudinal sectioned view of a wall of an inner tube 120 is shown. The inner tube 120 has an external surface 122 and an internal surface 124 with holes 126 extending between the external and internal surfaces 122, 124 as shown. An external skin 128 is formed over the external surface 122 so that the holes 126 are accessible only from the internal surface 124. The holes 126 retain lubricant for lubricating a sampled core (not shown), for example, from drilling fluid flowing through the inner tube 120. The inner tube 120 and the external skin 128 may be made from the same material or may be made from different materials. For example, the inner tube 120 may be made from steel or aluminium and the external skin may be made from a GRP or other composite material.

FIG. 13 illustrates a portion of an internal surface of an inner tube comprising a plurality of regularly or irregularly spaced apart holes. The holes shown are oval or elliptical. However, it will be appreciated that circular holes and holes having any other suitable cross-section are also possible. Additionally, although FIG. 13 has been described above as illustrating a surface comprising elliptical, oval, or other configurations of holes, it will readily be appreciated that the same pattern may be used to provide a textured surface, without forming a completed hole there through.

Figure 14:
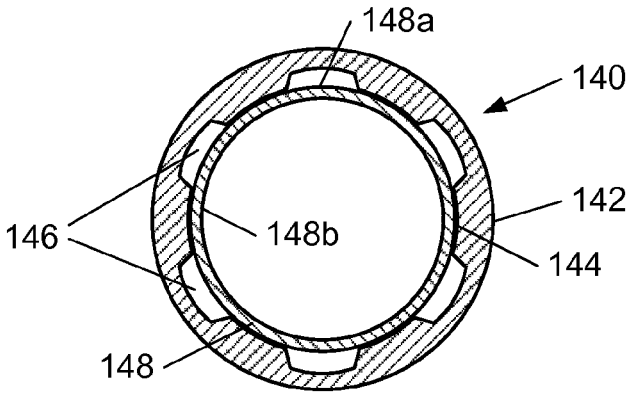
FIG. 14 illustrates a cross-sectioned view of an inner tube having flutes arranged on its internal surface, the inner tube being used with a liner in accordance with a twelfth example embodiment.
Figure 15:
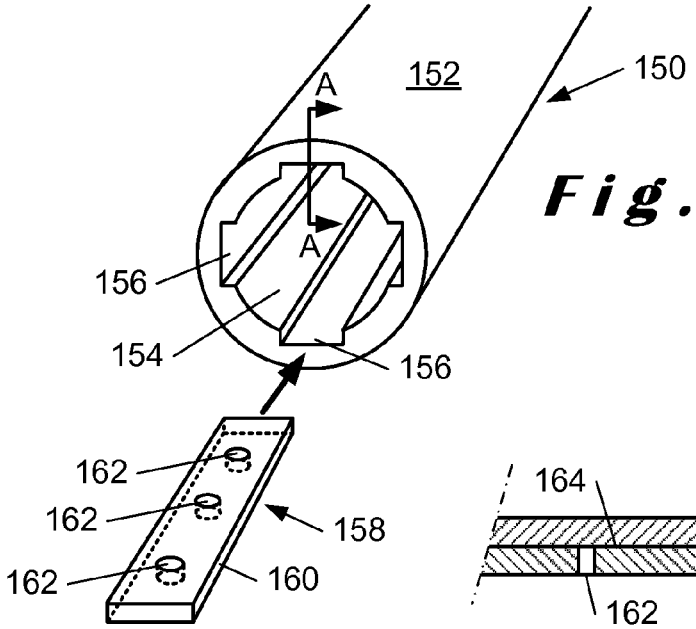
FIG. 15 illustrates a perspective view of a fluted inner tube in accordance with a twelfth example embodiment.
Figure 16:
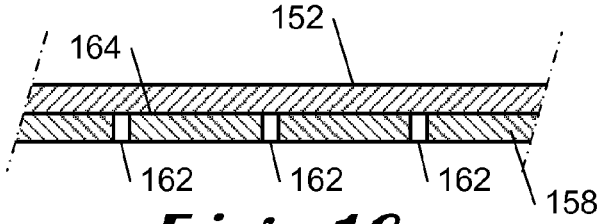
FIG. 16 illustrates a section on lines A-A of FIG. 15.

Lubricants can also be trapped in fluted arrangements as shown in FIGS. 14 to 16. Referring initially to FIG. 14, a cross-section through an inner tube 140 is shown. The inner tube 140 has an external surface 142 and an internal surface 144 with the internal surface 144 having a plurality of flutes 146 formed therein, each flute 146 extending in a direction along the length of the inner tube 140. Although only four flutes 146 are shown, it will be appreciated that any suitable number of flutes can be provided as required.

Lubricant is introduced into each flute prior to a liner 148 being located within the inner tube 140, the liner 148 retaining the lubricant in the flutes 146. The inner sleeve 148 has an external surface **148*a* and an internal surface 148*b*, and is located within the inner tube 140 with its external surface 148*a* adjacent the internal surface 144 thereof. The liner 148 may be porous, for example, having one or more through holes (not shown) through which lubricant in the flute 146 can pass to lubricate the sampled core. The liner 148 may be porous or have holes formed therein in regions which are located by flutes 146 and extend the length therewith. Alternatively, the liner 148 is porous or has holes over it entire circumference an along its length. If the liner 148 is porous, the lubricant traverses an indirect route from the flutes 146 to the internal surface 148*b* thereof. If holes are provided in the liner 148, the lubricant has a direct route from a flute 146 and external surface 148*a* to internal surface 148*b* of the liner 148. Due to the porosity of the inner sleeve 148, lubricant can pass through the inner sleeve 148 and form a lubricating layer on the internal surface 148*b* for the sampled core. In addition, the internal surface 148***b* of the inner sleeve 148 may be textured to assist in the retention of lubricant thereon. Examples of possible textures are described below with reference to FIGS. 22 to 24 below.

Referring now to FIGS. 15 and 16, FIG. 16 illustrates a perspective view of an inner tube 150 having an external surface 152 and an internal surface 154. The internal surface 154 is fluted, that is, it comprises a plurality of flutes 156 extending in a direction along the length of the inner tube 150. A plurality of bar elements 158 is inserted into respective ones of the flutes 156, only one such bar 158 being shown in FIG. 15. It will be appreciated that although only four flutes 156 are shown, any suitable number of flutes can be implemented with each one having a bar element 158.

Each bar element 158 comprises a substantially rectangular bar 160 in which a plurality of through holes 162 are spaced along the length of the bar 160. Although only three such through holes are shown, it will be appreciated that any suitable number of through holes can be implemented depending on the length of the flute 156 and the bar element 158 which is to be inserted therein.

FIG. 16 illustrates a longitudinal cross-section taken along line A-A in FIG. 15 through inner tube 150 with a bar element 158 located in a flute 156. Ends of the through holes 162 are sealed by lower surface 164 of the flute 156. As described above with reference to FIG. 12, the through holes 162 retain lubricant so that a sampled core (not shown) does not jam within the inner tube 150 (FIG. 15).

It will be appreciated that the embodiment shown in FIGS. 15 and 16 is effectively a combination of flutes as described with reference to FIG. 14 and holes as described with reference to FIG. 12. This has the advantage that holes do not need to be provided in the inner tube itself and are provided by holes in the bar elements as described above.

Figure 17:
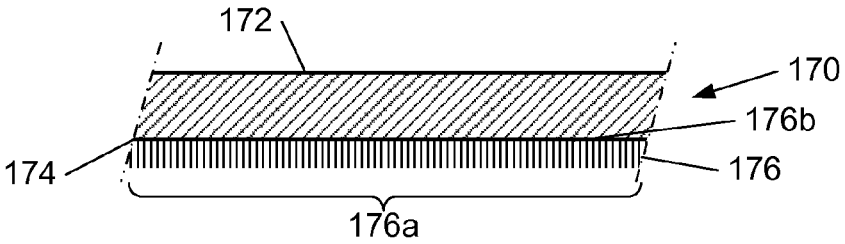
FIGS. 17 to 19 respectively illustrate sectioned views through wall portions of inner tubes in which fibres or bristles are attached to the internal surface in accordance with further embodiments of the present invention.
Figure 18:
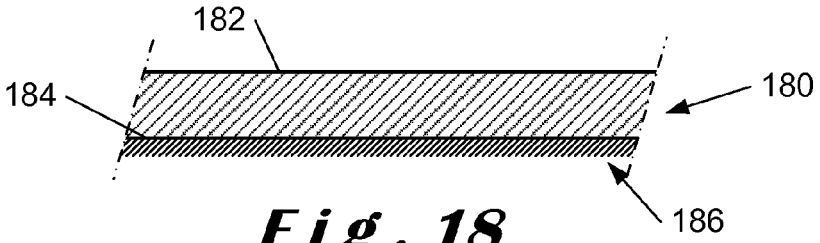
Figure 19:
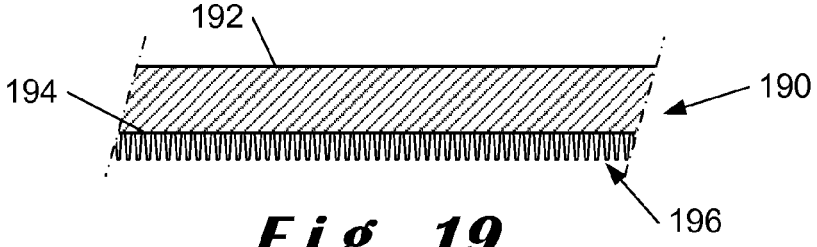

FIGS. 17 to 19 illustrate further examples of inner tubes with a textured surface, for example, having a pile or other flexible surface. In FIG. 17, a partial sectioned view of a wall portion of an inner tube 170 is shown. The inner tube 170 has an external surface 172 and an internal surface 174. A layer 176 of flexible material is formed on the internal surface 174. The layer 176 comprises a "pile" similar to that of an artificial carpet, that is, a plurality of fibres 176*a* fixed to a backing layer 176*b*. The fibres 176*a* may comprise any suitable natural or artificial material which can project from the backing layer 176*b* as shown and which can trap lubricant between the fibres. The backing layer 176*b* can be any suitable bonding material for supporting the fibres 176*a*, for example, a matting layer or an adhesive layer.

FIG. 18 is similar to FIG. 17 and shows a partial longitudinal sectioned view of a wall of an inner tube 180. The inner tube 180 has an external surface 182 and an internal surface 184. A layer 186 of flexible material is formed on the internal surface 184. The layer 186 comprises a "pile" similar to that of an artificial carpet, that is, a plurality of fibres 186*a* fixed to a backing layer 186*b*, but in this case, the fibres 186*a* are arranged at an angle with respect to the internal surface 184. The angle is in the same direction to that of insertion of a sampled core (not shown) so as to ease entry of the sampled core into the inner tube and so that lubricant can be applied to the sampled core by the pile as it enters into the inner tube 180. In both FIGS. 17 and 18, the layer of flexible material can be formed as part of a liner which is inserted into the inner tube, the fibres of the flexible material retaining lubricant for lubricating the sampled core.

In FIG. 19, a partial longitudinal sectioned view of a wall of an inner tube 190 is shown. The inner tube 190 has an external surface 192 and an internal surface 194. A plurality of flexible bristles 196 are fixed to the internal surface 194. Lubricant can be retained between the flexible bristles 196 and is applied to the sampled core as it passes over the bristles 196. The flexible bristles 196 may alternatively be formed on a liner that is inserted into the inner tube 190.

Figure 20:
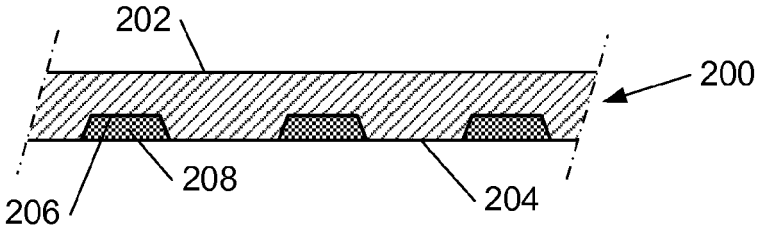
FIG. 20 is similar to FIG. 3 but includes lubricant provided in the radial grooves in accordance with another example embodiment.

FIG. 20 illustrates a partial longitudinal sectioned view of a wall of an inner tube 200. The inner tube 200 has an external surface 202 and an internal surface 204 in which a plurality of radial grooves 206 is formed. This is similar to the embodiment described with reference to FIG. 3. However, in this embodiment, the radial grooves 206 are filled with another material 208, for example, a lubricating material. Although the internal surface 204 is describe as having radial grooves 206, helical grooves or other suitable cut-outs may be provided that can trap or otherwise retain lubricant for the sampled core.

Figure 21:
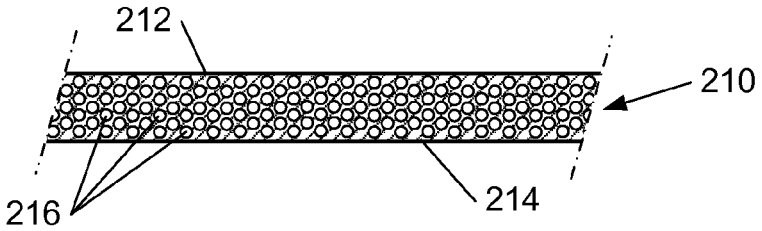
FIG. 21 illustrates a partial sectioned view of a wall portion of an inner tube having a porous internal surface in accordance with yet another example embodiment.

In FIG. 21, a partial longitudinal sectioned view of a wall of an inner tube 210 is shown. The inner tube 210 has an external surface 212 and an internal surface 214. In this case, the inner tube 210 is porous and has a plurality of pores 216 formed in its internal surface 214. The pores 216 allow lubricant to be trapped therein to lubricate a sampled core (not shown). In this embodiment, the inner tube 210 may form part of a triple tube system for a core barrel as described above.

Figure 22:
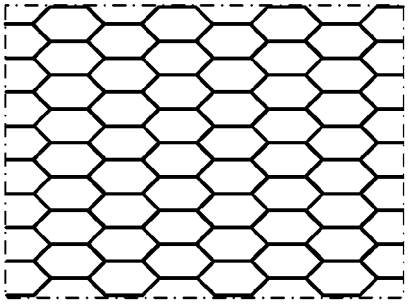
FIGS. 22 to 24 respectively illustrate possible surface patterns for inner tubes and/or liners in accordance with the present invention.
Figure 23:
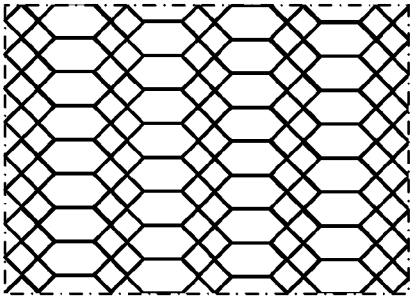
Figure 24:
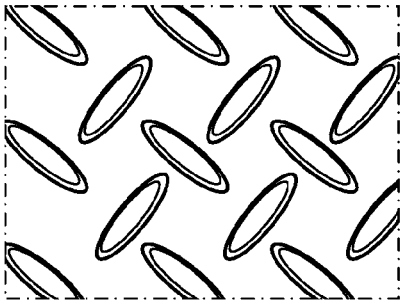

As described above, the internal surface of the inner tube or the internal surface of a liner placed within the inner tube may be textured. FIGS. 22 to 24 illustrate possible surface textures that can be applied to the internal surfaces of the inner tubes and/or the liners described above. FIG. 22 illustrates a surface texture comprising a plurality of hexagons; FIG. 23 illustrates a surface texture that comprises a plurality of hexagons; and FIG. 24 illustrates a surface texture comprising a plurality of elliptical projections. Alternatively, the surface texture in FIG. 24 may be elliptical depressions. It will be appreciated that the surface texture may be provided by a plurality of other regular or irregular shapes, for example, triangles, squares, pentagons etc.

It will be appreciated that the type of structure used to retain lubricant may depend on the type of lubricant being used and the diameter of the inner tube, and that in most instances, the structure relies on capillary action to trap lubricant for lubricating the sampled core. Possible lubricants include a relatively low viscosity liquid, for example, drilling mud; a relatively high viscosity material, for example, grease. Additionally, the lubricant may include a generally solid low friction material, such as, for example Polytetrafluoroethylene, commonly marketed under the name Teflon®. In systems using such a solid lubricant surface, the material may be disposed in the surface contours as described herein for retaining less viscous lubricants such as those identified above. Naturally, this list is not exhaustive and any suitable material may be used as a lubricant, either in solid or liquid form, which does not interact with the sampled core.

Figure 25:
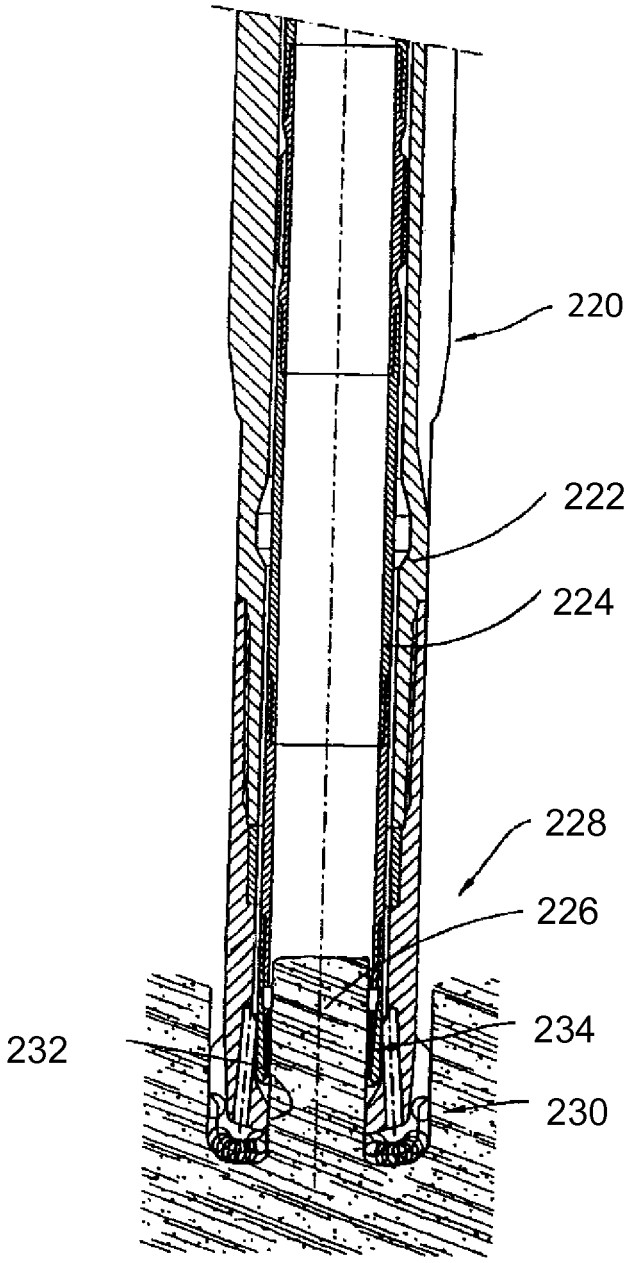
FIG. 25 illustrates an example coring device as may be used with any of the described inner tube configurations to provide new coring devices and methods.

Referring now to FIG. 25, that figure depicts an example coring device comprising a core barrel 220 that may be enhanced through the addition of a lubricating surface as described by the examples of the embodiments above, and used to provide improved sampling of cores. Core barrel 220 includes an outer tube or housing 222 with an inner tube 224 retained therein through an attachment assembly 234. Outer housing 222 is coupled to a coring bit 230 to form an outer housing assembly. Core barrel 220 is depicted in the midst of a coring operation though which a core 226 is being sampled and thereby received within the interior of coring bit 226 and further within an interior surface 236 of inner tube 224. The inner tube as described herein may be formed as an assembly of multiple components as depicted in FIG. 25. Additionally, the lubricating structures or features may be provided throughout the length of the inner tube or only in portions thereof; and as noted above in regard to certain embodiments, may be provided uniformly or non-uniformly across a selected portion of the inner tube.

Those skilled in the art will readily appreciate that the core barrel may be a portion of a wireline-conveyed core sampler. One of many possible examples of such a device would be a sidewall core sampler. Thus, the application of the present novel systems identified by the examples herein is not limited to any particular configuration of core sampling device.

Although the present invention has been described above with reference to specific embodiments of structures for lubricating a sampled core, it will be appreciated that these embodiments are not limiting and that other embodiments that provide a means for retaining lubricant for lubricating a sampled core are also possible without departing from the spirit and scope of the present invention.

What is claimed is:

1. A coring device, comprising:

a core barrel assembly to receive a core from a bit, including, a core barrel, and a rigid inner tube secured in a fixed position in the core barrel and including a threaded connection at a first end of the rigid inner tube and a threaded connection at a second end of the rigid inner tube, the rigid inner tube defining an internal core receiving surface having multiple rigid structures that retain lubricant and are distributed circumferentially across the core receiving surface over substantially the entire length of the rigid inner tube, the retained lubricant disposed within the rigid structures to lubricate an outer portion of a sampled core within the rigid inner tube.

2. The coring device of claim 1, wherein the multiple rigid structures comprise a plurality of alveoli fanned across the internal core receiving surface.

3. The coring device of claim 1, wherein the lubricant retaining structure comprises a plurality of grooves formed in the core receiving surface.

4. The coring device of claim 3, wherein the plurality of grooves comprise radial grooves.

5. The coring device of claim 3, wherein the plurality of grooves comprise at least one helical groove.

6. The coring device of claim 3, wherein the plurality of grooves comprise at least two helical grooves extending in the opposite directions form one another.

7. The coring device of claim 3, wherein the grooves comprise at least two sets of helical grooves rotating in the same direction.

8. The coring device of claim 1, wherein the threaded connection at the first end of the rigid inner tube is a threaded pin connection and wherein the threaded connection at the second end of the rigid inner tube is a threaded box connection.

9. A coring device comprising:

a threaded portion on at least one end thereof configured to threadably couple an inner tube within a core barrel of the coring device to define an internal core-receiving surface, wherein the rigid inner tube comprising a threaded connection at a first end of the inner tube and a threaded connection at a second end of the inner tube; and the core-receiving surface including multiple rigid structures that retain lubricant and are distributed circumferentially across the core-receiving surface over substantially the entire length of the core-receiving surface, the retained lubricant disposed within the rigid lubricant containment structures to lubricate an outer portion of a sampled core.

10. The core sampling inner tube of claim 9, wherein the structure comprises an undulating surface.

11. The core sampling inner tube of claim 9, wherein the undulating surface comprises a helicoidal surface.

12. The core sampling inner tube of claim 9, wherein the at least one structure comprises a plurality of holes extending from the external surface to the internal surface of the inner tube.

13. A core sampling inner tube according to claim 12, further comprising an external skin located on an external surface of the inner tube.

14. The core sampling inner tube of claim 9, wherein the at least one structure comprises a porous internal surface.

15. The core sampling inner tube of claim 9, wherein the at least one structure comprises a plurality of flutes extending along the length of the internal surface.

16. The core sampling inner tube of claim 15, wherein each flute includes an elongate member having a plurality of holes formed therein.

17. The core sampling inner tube of claim 16, further comprising a liner arranged on the internal surface of the inner tube, the liner configured to apply a lubricant from the flutes to the sampled core.

18. The core sampling inner tube of claim 17, wherein the at least one structure comprises a flexible material attached to the internal surface.

19. The coring device of claim 9, wherein the threaded connection at the first end of the inner tube is a threaded pin connection and the threaded connection at the second end of the inner tube is a threaded box connection.

20. A method of obtaining a core, comprising:

cutting a core with a cutting mechanism;

receiving the core as it is cut in a rigid internal sleeve within a core barrel assembly;

and wherein said receiving includes lubricating the received core through use of an inner surface of the rigid internal sleeve that includes at least one threaded end threadably coupled into the core barrel assembly, wherein the inner surface includes a plurality of alveoli fanned across the inner surface that are each configured to retain lubricant and are distributed circumferentially across the inner surface over substantially the entire length of the rigid internal sleeve, the retained lubricant disposed within the alveoli to lubricate an outer portion of the received core.

21. The method of obtaining a core of claim 20, wherein the lubricant comprises at least one of drilling mud or grease.

22. The coring device of claim 9, wherein the multiple rigid structures comprise a plurality of alveoli fanned across the core-receiving surface.

* * * * *